United States Patent [19]

Muck

[11] 4,411,388

[45] Oct. 25, 1983

[54] APPARATUS FOR CONVEYING LIGHTWEIGHT PARTICULATE MATTER

[76] Inventor: Jack E. Muck, 1511 Clarence Ave., Lakewood, Ohio 44107

[21] Appl. No.: 247,895

[22] Filed: Mar. 26, 1981

[51] Int. Cl.[3] ..... B05B 7/04

[52] U.S. Cl. ..... 239/419.5; 239/422; 239/434.5; 406/135; 406/191

[58] Field of Search ..... 406/122, 135, 153, 128, 406/191; 239/422, 423, 433, 434.5, 424.5, 419.5

[56] References Cited

U.S. PATENT DOCUMENTS

| | | | |
|---|---|---|---|
| 628,187 | 7/1899 | Sibley . | |
| 1,082,113 | 12/1913 | Diden . | |
| 1,152,302 | 8/1915 | Davenport . | |
| 1,311,297 | 7/1919 | Strong . | |
| 1,341,010 | 5/1920 | Cartwright . | |
| 1,686,713 | 10/1928 | Scott . | |
| 1,892,920 | 1/1933 | Weiss . | |
| 1,943,780 | 1/1934 | Allen | 406/128 |
| 2,495,540 | 1/1950 | Nichols et al. | 427/196 |
| 2,585,133 | 2/1952 | Kempthorne | 239/422 |
| 2,673,125 | 3/1954 | Squire | 406/137 |
| 3,152,839 | 10/1964 | Edwards | 302/25 |
| 3,276,821 | 10/1966 | Edwards | 406/128 |
| 3,314,732 | 4/1967 | Hagan | 406/135 X |
| 3,368,849 | 2/1968 | Cheely | 302/15 |
| 3,424,386 | 1/1969 | Maasberg | 239/427.3 |
| 3,870,282 | 3/1975 | Lacchia | 239/15 |
| 3,907,170 | 9/1975 | Schedrin et al. | 222/135 |
| 3,957,209 | 5/1976 | Thomson | 239/433 |
| 3,972,150 | 8/1976 | Hart | 51/11 |

*Primary Examiner*—Andres Kashnikow
*Assistant Examiner*—Gene A. Church
*Attorney, Agent, or Firm*—Woodling, Krost & Rust

[57] ABSTRACT

An improved apparatus for conveying friable lightweight particulate matter without destruction or excessive powdering is disclosed. A jet suction nozzle permits a gradual transition of pressure in the critical zone in which the material is acted upon by the jets. This is accomplished by a low jet duct angle and by the use of greater than usual quantities of air at lower than the usual pressures.

3 Claims, 5 Drawing Figures

APPARATUS FOR CONVEYING LIGHTWEIGHT PARTICULATE MATTER

The present invention relates to the conveyance by hose of lightweight particulate matter, such as various insulation materials, for deposition or spraying at any desired location. It is especially adpated for materials which are friable. Such materials have been easily destroyed by prior similar apparatus and methods.

BACKGROUND OF THE INVENTION

The prior art contains many examples of devices for conveying or spraying insulation, ashes, slurries and the like, by pneumatic means. Many are of the jet suction or jet assisted type, wherein jets of a liquid or gas under pressure are introduced into a stream of the material being conveyed, or are used at the terminus to create suction of the material. These types of devices function effectively so long as the material being conveyed is not effected by sudden increases in pressure or turbulence, or so long as it is not important that the structural integrity of the material be preserved, as in the case of ash conveyors. But certain of the newer particulate insulation materials, for example, Dacotherm®, have presented a problem. The conventional means of delivery by hose until the present have proven unfeasible as such means tend to disintegrate and powder the material excessively.

OBJECTS AND SUMMARY OF INVENTION

An object of my invention is to provide for conveying lightweight and friable particulate matter by hose or similar means without substantially interfering with the structural integrity of the particles.

A further object of my invention is to provide a new and improved nozzle for the suction and delivery of lightweight particulate matter.

Other objects and a fuller understanding of the invention may be had by reference to the following description and claims, taken in conjunction with the accompanying drawings in which FIG. 1 is a schematic representation of the entire transport and delivery system utilizing my invention;

Figure 1:
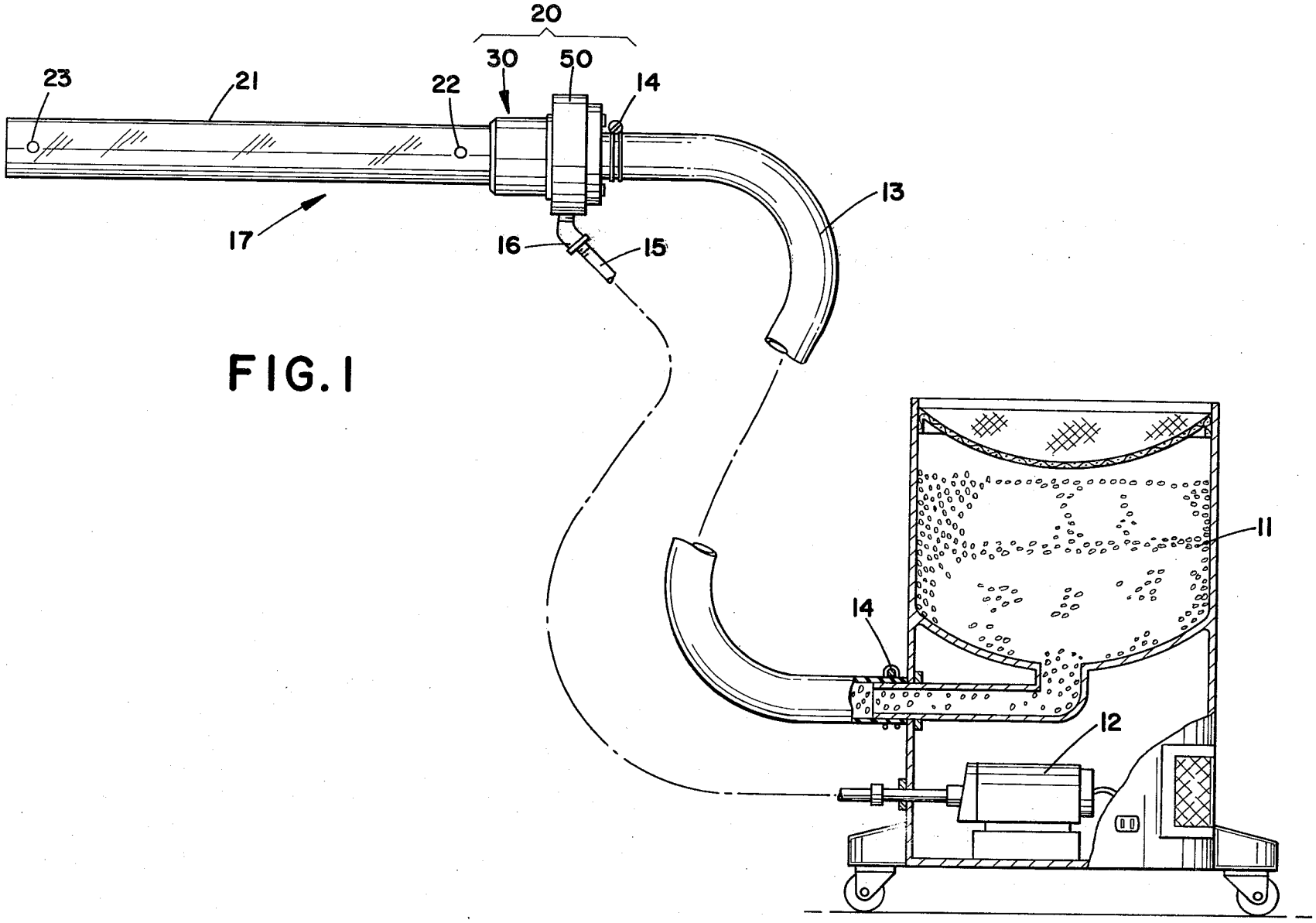
Figure 2:
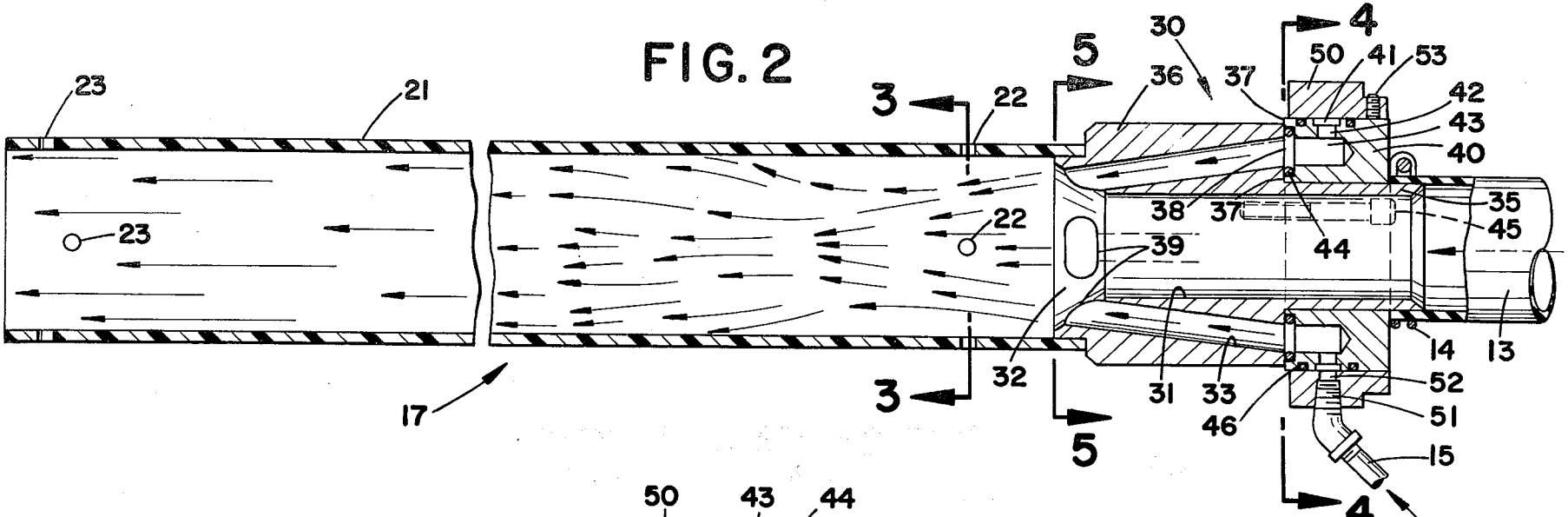
FIG. 2 is a sectional view of the nozzle of my invention.

FIG. 1 shows the normal method of using my invention, the improved nozzle of FIG. 2. In FIG. 1 the entire system appears. It comprises essentially a bin 11 into which the particulate material is poured, preferably through a filter, a source 12 of compressed air, a nozzle 17 in which suction for the particulate materials is generated and which ejects the material, transport tubing 13 to convey the material from the bin 11 to the nozzle 17, and fastened to the bin and nozzle by clamps 14, and air pressure tubing 15 to convey air pressure from its source 12 to the nozzle 17, fastened to the nozzle by hose connector 16. It will be understood that features 11 through 16 are conventional and admit of many equivalents familiar to those skilled in the art.

Figure 5:
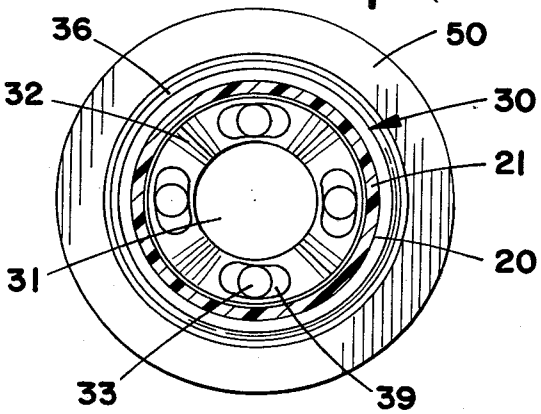
FIG. 5 is another cross-sectional view, taken through the plane 5—5 in FIG. 2.
Figure 4:
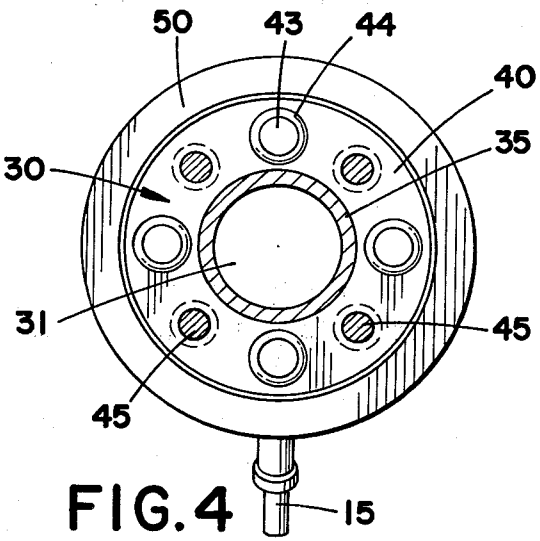
FIG. 4 is a cross-sectional view taken through the plane 4—4 in FIG. 2.
Figure 3:
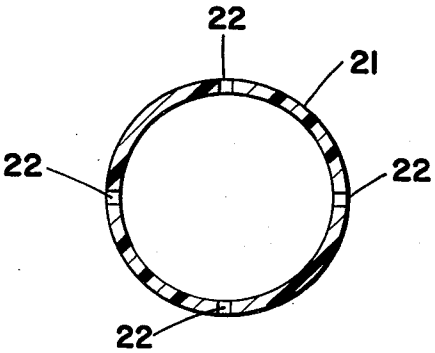
FIG. 3 is a cross-sectional view taken through the plane shown as 3—3 in FIG. 2.

The nozzle 17 is shown in FIG. 1 as being made up of two parts. In the preferred embodiment of my invention these are a housing 20 and a nozzle tube 21. In turn the housing 20 comprises three members, as is more clearly shown in FIG. 2. These are a duct carrying member 30, an air manifold 40 and an outer ring 50. The cross-sections of FIGS. 3 to 5 show the locations of various duct openings to be described.

The duct carrying member 30 is generally in the shape of two coaxial cylinders joined end to end. They are a smaller receiving portion 35 and a larger duct portion 36. Since the cylinders are unequal in radius, a shoulder 37 is located where they are joined. The entire duct carrying member 30 is traversed by a transport duct 31. It has a cylindrical bore in the smaller receiving portion 35 and in most of the larger duct portion 36, but has a flared frusto-conical bore portion 32 at its end. Passing through the larger duct portion 36 from shoulder openings 38 in the shoulder 37 to duct openings 39 in the flared part 32 of the transport duct 31, are four air jet ducts 33. They are evenly spaced about the periphery of the transport duct 31.

The air manifold 40 is a cylindrical member with an inner bore coaxial with the duct carrying member 30, of such size that it is received snugly but slidably by the smaller receiving portion 35 of the duct carrying member 30. One end abuts the shoulder 37 of the duct carrying member 30. Recessed into outer cylindrical wall of the air manifold 40 is an annular manifold duct 41, from which extend radially in the direction toward the axis, four first inlet ducts 42. Each such first inlet duct 42 opens into a corresponding second inlet duct 43. In turn, each second inlet duct 43 extends axially to the end of the air manifold 40 which abuts the shoulder 37 of the duct carrying member 30. The openings of the second inlet ducts 43 at the shoulder 37 correspond in position to the shoulder openings 38 of the air jet ducts 33, and an airtight seal is made around the openings at the plane of abutment by small O-rings 44. The air manifold 40 is secured to the duct carrying member 30 by any suitable fastening means such as bolts 45 (shown in phantom) circumferentially spaced around the axis of the air manifold 40 and extending into the duct carrying member 30.

On both sides of the manifold duct 41, and parallel to it, are grooves which bear large O-rings 46. The two O-rings 46 provide an airtight seal between the air manifold 40 and the outer ring 50. This cylindrical ring surrounds the air manifold 40, being snugly but rotatably mounted thereon, and seals with its inner wall the manifold duct 41 except at one place where an air port duct 52 opens into the inner wall. The air port duct is continuous with the interior of an air port member 51. This member is threadedly connected to the outer ring 50 and serves to conduct compressed air from the air pressure hose, via the air port duct 52, to the manifold duct 41. The outer ring 50 is secured against rotation upon the air manifold 40 by a set screw 53, loosening of which permits readjustment of the position at which the air pressure hose 15 is connected to the housing 20.

The nozzle tube 21 is a cylinder with a front end and a rear end. The rear end is secured to the front of the duct carrying member 30. The bore of the nozzle tube 21 is slightly larger than that of the transport duct 31 at its flared portion 32. The nozzle tube 21 is provided with two sets 22 and 23 of holes. Each set of holes is evenly spaced about the circumference of the nozzle tube 21. Set of holes 22 is located near the rear end and set 23 near the front end of the nozzle tube 21.

In the present preferred embodiment, the inside diameter of the nozzle tube is about three inches, that of the transport duct about two inches and that of the air jet ducts about one half inch. The length of the nozzle tube is about twenty inches, and the air jets enter the tube at an angle of about seven degrees. However it should be understood that these dimensions may be varied with respect to each other in accordance with the principles next to be described.

PRINCIPLES AND METHODS OF OPERATION OF INVENTION

The objects of my invention, in particular, that of conveying friable matter in a non-destructive manner, have been uniquely achieved.

To understand this achievement, it must first be appreciated that in order to preserve the structural integrity of a material such as Dacotherm®, it cannot be subjected to rapid increases in pressure or to the amounts of turbulence which occur at various places in the pre-existing devices.

I have solved this problem by several interrelated means. First, the stream of conveyed material is kept in a generally straight line and the angle at which the jets enter the stream is less than that ordinarily employed. Optimally the angle lies between five and fifteen degrees, but it can be as low as three degrees or as high as thirty degrees with an appropriate change in the other dimensions, pressure or particle size and density. Secondly, greater quantities of air, at lower pressures than the typical jet suction or Venturi devices, are used to create the suction.

My design permits a gradual transition from a low pressure in the transport hose to a pressure in the nozzle which is higher than that in the transport hose but at no point is as high as encountered in pre-existing devices. This is accomplished by the jet duct angle, and, in addition, by having large jet ducts of total cross-section approximately that of the transport duct, by having holes in the nozzle, or by both of these means employed simultaneously.

The holes in the nozzle tube of the preferred embodiment confer various advantages. They permit air to be drawn in near the zone where the jets impinge on the air-entrained solids and permit air to exit near the end of the tube. This promotes a more gradual change in pressure, discourages "fanning out" of the stream exiting the tube, and tends to keep the particles from destructive impact on the side walls of the tube. The intake holes are preferably situated about halfway between the air duct openings and the impingement zone, and the exhaust holes close to the end of the nozzle tube, optimally 80% to 85% of the way downstream. These figures will vary with a change in the other parameters.

Another helpful factor is that the tube is relatively long with respect to the impingement location; I have found that for the best results the point of convergence of the axes of the jet ducts should be located about 25% to 40% of the way towards the end of the tube.

In use an air pressure at the nozzle of from five to ten PSIG is ordinarily appropriate, depending on the density of the particulate matter desired to be transported. I have estimated that in the embodiment disclosed here this pressure delivers 75 to 85 cubic feet of air per minute to the nozzle, and results in the transportation of about six cubic feet of Dacotherm® (density 2.2 lb/ft$^3$) per minute. A material such as perlite (density 7.5–8.0 lb/ft$^3$) would require a higher air pressure and volume of air.

Although this invention has been described in its preferred form and preferred practice with a certain degree of particularity, it is understood that the present disclosure of the preferred form and preferred practice has been made only by way of example and that numerous changes in the details of construction and the combination and arrangement of parts and steps may be resorted to without departing from the spirit and the scope of the invention as hereinafter claimed.

What is claimed is:

1. In an apparatus of the jet suction type for pneumatically conveying lightweight particulate matter and ejecting it at a desired location, said apparatus including a source of said particulate matter, a source of air pressure, a nozzle, transport tubing means for conveying said particulate matter from its said source to said nozzle, and air pressure tubing means for conveying air pressure from its said source to said nozzle, an improved nozzle comprising a generally tubular housing with rear and front ends, said housing containing therein a central transport duct with an axis passing therethrough from said rear to said front end and being joined at said rear end of said housing with said transport tubing means whereby said particulate matter may pass freely from said transport tubing means into and through said central transport duct, said housing further being provided with a plurality of jet ducts having axes and having openings located peripherally about said front end of said central transport duct, each of which jet ducts is joined with said air pressure tubing means whereby air is forced through said jet ducts, exiting said jet ducts as air jets, a nozzle tube with a cylindrical interior, an axis, a rear end and a front end, said nozzle tube being joined at its rear end with said front end of said housing, said transport duct and jet ducts opening into said nozzle tube interior, said jet duct axes being inclined forwardly toward the axis of said nozzle tube such that said air jets meet each other at a point on said axis of said nozzle tube, said air jets meeting said axes of said nozzle tube at an angle of between 3 and 30 degrees, and said nozzle tube being provided with a first and a second set of holes, said first set being a plurality of holes spaced generally evenly about the circumference of said nozzle tube rearwardly of said point where said air jets meet, and said second set being a plurality of holes spaced generally evenly about the circumference of said nozzle tube frontwardly of said point where said air jets meet.

2. The improvement of claim 1 and wherein the ratio of the distance of the first said set of holes from said rear end of said nozzle tube to the distance of the said point at which said air jets meet each other to the said rear end of said nozzle tube lies between 0.3 and 0.7.

3. The improvement of claim 1 and wherein the said second set of holes is located at a distance from said front end of said nozzle tube of between 10% and 25% of the length of said nozzle tube.

* * * * *